United States Patent [19]

Wang

[11] Patent Number: 4,651,360

[45] Date of Patent: Mar. 24, 1987

[54] INFLATABLE POOL

[76] Inventor: Cheng C. Wang, 7th Floor, No. 37, An-Ho Road, Taipei, Taiwan

[21] Appl. No.: 738,067

[22] Filed: May 24, 1985

Related U.S. Application Data

[63] Continuation-in-part of Ser. No. 467,546, Feb. 17, 1983, Pat. No. 4,547,919.

[51] Int. Cl.[4] ..... E04H 3/18; A47K 3/06

[52] U.S. Cl. ..... 4/506; 4/588; 52/2; 150/55; 383/3

[58] Field of Search ..... 4/506, 488, 588; 5/449, 5/455, 457, 458; 52/2; 383/3; 150/55

[56] References Cited

U.S. PATENT DOCUMENTS 3,030,640 4/1962 Gosman ..... 5/455
3,631,544 1/1972 Tytel ..... 4/506
3,780,388 12/1973 Thomas et al. ..... 5/457
4,360,396 11/1982 Marbach ..... 5/457

FOREIGN PATENT DOCUMENTS 1408023 6/1965 France ..... 4/506

*Primary Examiner*—Alexander Grosz
*Attorney, Agent, or Firm*—McGlew and Tuttle

[57] ABSTRACT

An inflatable pool which comprises a base sheet and a hollow-shaped inflatable wall having its bottom end heat-sealed to the edge of the base sheet. The wall is provided with outer heat seal seams and inner heat seal seams which are extending axially and dividing the wall into a plurality of elongated air compartments intercommunicated and structurally interconnected. The outer heat seal seams are staggered with respect to the inner heat seal seams and the upper portion of the wall is a continuous seal free portion.

2 Claims, 5 Drawing Figures

INFLATABLE POOL

CROSS-REFERENCE TO RELATED APPLICATION

This is a continuation-in-part application of U.S. Ser. No. 467,546 filed on Feb. 17, 1983 which is now U.S. Pat. No. 4,547,919.

BACKGROUND OF THE INVENTION

This invention relates to an inflatable pool and particularly to an inflatable pool having an inflatable wall with axially extending and intercommunicated elongated air compartments and axial heat seal seams at the outer side and the inner side of the wall, each heat seal seam on the outer side being staggered with the inner side of the wall.

It is known in the art to provide a portable and collapsible inflatable pool for use as a bath tub or a swimming pool for children. A typical inflatable pool available heretofore includes a tubular inflatable wall with a single tubular air compartment which is usually fabricated in a smaller size and height because of the weakness in its construction. There is also provided another form of inflatable pool which has a tubular inflatable wall with two or more intercommunicated tubular air compartments structurally interconnected along ring-shaped heat seal seams. Such a construction permits the fabrication of a larger pool, but, when a large quanitity of water is held in the pool, the wall thereof becomes deformed. Therefore, it is still necessary to provide a stronger and stiffer wall for a large inflatable pool which is capable of bearing greater fluid pressure.

A strong construction for inflatable articles, such as seat cushions, matresses, life rafts, life jackets, sleeping bags and the like was proposed in U.S. Pat. No. 3,030,640. These articles are composed of permanently inflated non-communicating compartments whose individual puncturing and deflation will not result in the deflation of the other inflated compartments. Since the permanently inflated non-communicating compartments can not allow the article to be deflated and collapsed into a compact and portable size, such a construction is not suitable for the fabrication of a pool which is large and therefore must necessarily be deflated when it is stored.

Patent application Ser. No. 467,546 now U.S. Pat. No. 4,547,919 discloses the construction of multi-compartmented inflatable articles in which heat seal seams are reformed and reinforced. The invention of the present application is to apply such a construction in fabricating an inflatable pool.

SUMMARY OF THE INVENTION

An object of the invention is to provide an inflatable pool with stronger and stiffer construction.

This and other objects can be achieved in accordance with the present invention through the provision of an inflatable pool which is comprised of a base sheet made of a gas impervious heat-sealable material and having an edge bounding said sheet, and a hollow-shaped inflatable wall made of a gas impervious, heat-weldable material and having its bottom end heat-welded to the edge of the base sheet. The wall includes a first sheet curved to form a hollow shape and having an upper edge and a second sheet which has a portion fully covering the inner surface of the first sheet and heat sealed to the first sheet along first axially extending seams to form structurally fixedly interconnected and intercommunicated first elongated air compartments. The second sheet further includes one continuous seal free portion folded and extending over the upper edge of the first sheet and the remaining portion heat sealed to the outer side of the second sheet along second axially extending seams to form structurally fixedly interconnected and intercommunicated second elongated air compartments. Each second seam lies correspondingly between each adjacent two of the first seams.

There may be further provided a reinforcing ring shaped inflatable member connected to the bottom end of wall.

The present exemplary preferred embodiment will be described in detail with reference to the accompanying drawings, in which:

DETAILED DESCRIPTION OF THE PREFERRED EMBODIMENTS

Figure 1:
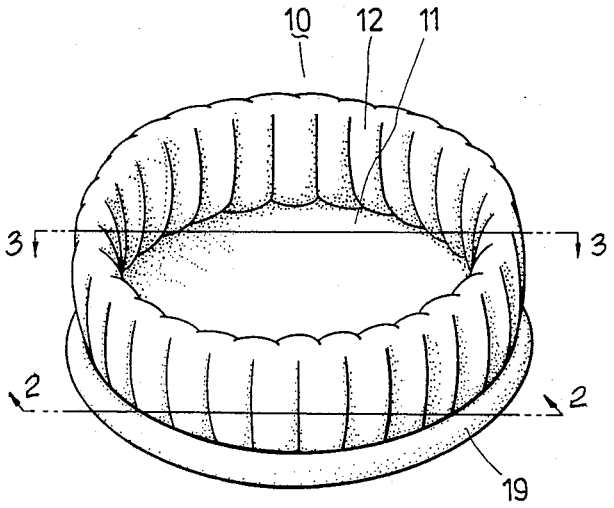
FIG. 1 is a perspective view of an inflatable pool embodying the present invention.
Figure 2:
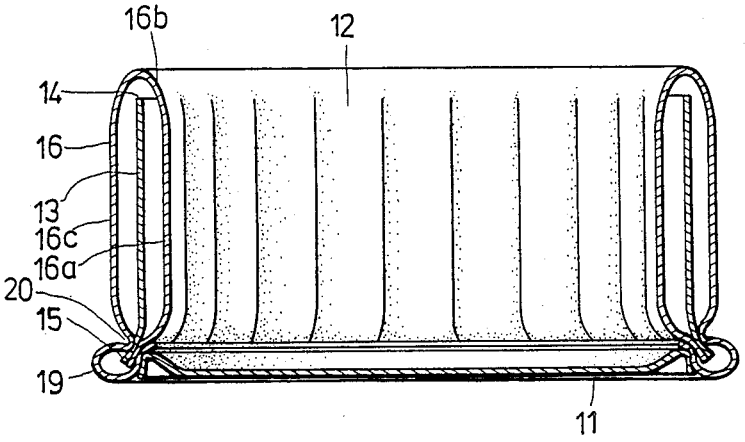
FIG. 2 is a sectional view taken along line 2—2 of FIG. 1.
Figure 3:
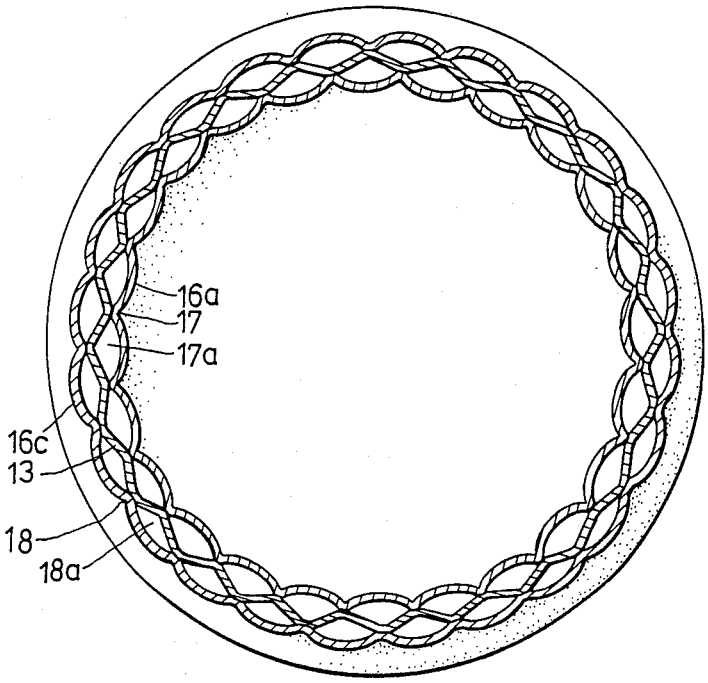
FIG. 3 is a sectional view taken along line 3—3 of FIG. 1.

Referring to FIGS. 1, 2 and 3, there is shown an inflatable pool 10 which includes a base sheet 11 with a circular edge and an inflatable hollow cylindrical wall 12 which are made of a gas impervious, heat sealable plastic material, such as PVC sheet. The wall 12 may also be a hollow oval shape or the like.

The wall 12 is composed of a sheet 13 which is curved to form a cylindrical shape and has an upper edge 14 and a lower edge 15. There is further provided a sheet 16 which has a width large enough to cover the whole inner surface of the sheet 13 and is heat sealed to the inner side of the sheet 13 along axial seams 17 extending from the upper edge 14 to the lower edge 15. The sheet 16 is then folded and extended over the upper edge 14 of the sheet 13. The portion that is extended over the upper edge 14 is a seal free portion **16*b*. The remaining portion 16*c* is extended downward to the lower edge 15 of the sheet 13 and heat sealed to the outer side of the sheet 13 along axial seams 18 which extend from the upper edge 14 to the lower edge 15 of the sheet 13. The seams 17 and 18 are arranged in such a manner that each seam 17 lies correspondingly between each two seams 18 so that the outer seams 18 are staggered with respect to the inner seams 17. The inner portion 16*a* of the sheet 16 and the outer portion 16*c* are further heat sealed to the lower edge 15 of the sheet 13 along a seam 20**.

The seams 17 and 18 divide the wall 12 into a plurality of axially extending inner elongated air compartments **17*a* and outer elongated air compartments 18*a* which are intercommunicated and structurally interconnected. Sine seams 17 and 18 are staggered relative to each other, the seams 17 can be stiffened by the corresponding air compartments 18*a* and seams 18 can be stiffened by the corresponding air compartments 17*a***, thereby achieving a stiffer and stronger construction for the wall of the pool.

There is further provided a reinforcing ring-shaped inflatable member 19 at the bottom end of the wall 12. The inflatable member 19 can be fabricated with the remaining portion 16*c* of the sheet 16 which extends from the heat seal seams 20. This extending portion is then flexed and the edge thereof is finally heat sealed at the seam 20. The base sheet 11 is also heat sealed to the sheet 16 at the seam 20.

Figure 4:
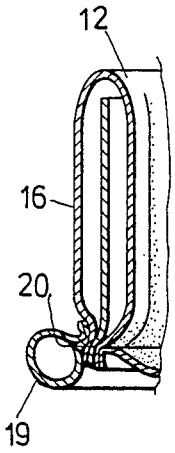
FIG. 4 is a fragmentary view of an inflatable pool with a ring member which is formed in a different way from that of FIG. 1.

Alternatively, the ring-shaped member 19 can be fabricated with another sheet as a separate part which can be heat sealed to the sheet 16 at the seam 20, as shown in FIG. 4.

Figure 5:
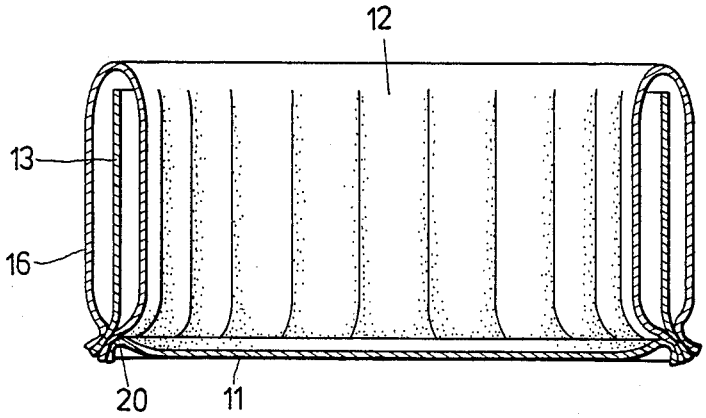
FIG. 5 is a sectional view of an inflatable pool without a ring member.

Referring to FIG. 5, there is shown another embodiment of the invention in which the construction of the pool is substantially similar to that of the pool shown in FIG. 1 except that it is not provided with a reinforcing ring-shaped inflatable member at the bottom end of the inflatable wall.

It can be appreciated that the pool constructed according to the invention also has an advantage in that it can be deflated and collapsed when not in use.

With the invention thus explained, it is apparent that various modifications and variations can be made without departing from the scope of the invention. It is therefore intended that the invention be limited as indicated in the appended claims.

I claim:

1. An inflatable pool comprising: a base sheet (11) made of a gas impervious, heat sealable material having an edge bounding said sheet and a hollow inflatable wall (12) made of a gas impervious, heat sealable material and having a bottom end heat sealed to said edge of said base sheet, said wall including a first sheet (13) which is curved to form a tubular shape, said first sheet having an inner surface, an outer surface, an upper edge (14), and a lower edge (15), said wall including a second sheet (16) having an inner portion (16*a*) fully covering said inner surface of said first sheet and heat sealed to said first sheet along a plurality of axially extending seams (17) to form structurally fixedly interconnected and intercommunicating first elongated air compartments (17*a*), said second sheet having a seal free portion (16*b*) extending over said upper edge of said first sheet, said second sheet having an outer portion (16*c*) connected to said seal free portion and substantially covering said outer surface of said first sheet, said outer portion being heat sealed to said outer surface of said first sheet along a plurality of axially extending seams (18) to form structurally fixedly interconnected and intercommunicating second elongated air compartments (18*a*), each of said second seams lying between adjacent ones of said first seams.

2. An inflatable pool as claimed claim 1, further including a reinforcing ring-shaped inflatable member (19) heat sealed to the bottom end of said wall.

* * * * *